US011261689B2

(12) United States Patent
Clunie et al.

(10) Patent No.: US 11,261,689 B2
(45) Date of Patent: Mar. 1, 2022

(54) SUBSEA AUTONOMOUS CHEMICAL INJECTION SYSTEM

(71) Applicant: Halliburton Energy Services, Inc., Houston, TX (US)

(72) Inventors: Alan Cameron Clunie, Stirling (GB); Iain James Shepherd, Aberdeen (GB); Quintin John Richterberg, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/923,061

(22) Filed: Jul. 7, 2020

(65) Prior Publication Data

US 2022/0010647 A1 Jan. 13, 2022

(51) Int. Cl.
*E21B 33/076* (2006.01)
*E21B 41/04* (2006.01)

(52) U.S. Cl.
CPC ..... *E21B 33/076* (2013.01); *E21B 41/04* (2013.01)

(58) Field of Classification Search
CPC ..... E21B 33/076; E21B 41/04
See application file for complete search history.

(56) References Cited

U.S. PATENT DOCUMENTS 4,635,723 A 1/1987 Spivey
5,111,883 A 5/1992 Savery
5,927,901 A 7/1999 Graves
6,327,914 B1 12/2001 Dutton
6,840,088 B2 * 1/2005 Tucker ..... F16L 1/26 73/49.5
7,234,524 B2 * 6/2007 Shaw ..... E21B 41/02 166/304
8,240,952 B2 8/2012 Loeb et al.
(Continued)

FOREIGN PATENT DOCUMENTS

EP 2351905 A1 4/2017
GB 2554527 A 4/2018
(Continued)

OTHER PUBLICATIONS

Korean Intellectual Property Office, PCT Application No. PCT/US2020/041087, International Search Report and Written Opinion, dated Mar. 29, 2021, 13 pages, Korea.

*Primary Examiner* — James G Sayre
(74) *Attorney, Agent, or Firm* — Haynes and Boone, LLP

(57) ABSTRACT

A subsea chemical injection system and method for injecting chemicals into a hydrocarbon production assembly adjacent the seabed wherein a seawater volume flowmeter is utilized to measure seawater pumped through the system and a chemical subsea mass flowmeter is used to measure a chemical injected into the seawater, where the chemical subsea mass flowmeter measures the chemical at a pressure less than the seawater pumped through the system. Based on the chemical subsea mass flowmeter measurement, the flowrate of a chemical injected into the seawater can be adjusted to a predetermined setpoint corresponding to the flowrate of seawater pumped through the system. The chemical subsea mass flowmeter includes a Coriolis tube and chemical injection process pump housed within a pressure vessel. The subsea chemical injection system may be carried on a skid.

20 Claims, 7 Drawing Sheets

(56) References Cited

U.S. PATENT DOCUMENTS

| | | | | |
|---|---|---|---|---|
| 8,778,052 | B2 | 7/2014 | Dam et al. | |
| 9,255,465 | B2 | 2/2016 | Smith, IV et al. | |
| 2012/0018148 | A1* | 1/2012 | Bryant | C09K 8/62<br>166/250.01 |
| 2020/0102813 | A1* | 4/2020 | Greig | E21B 41/04 |

FOREIGN PATENT DOCUMENTS

| | | | |
|---|---|---|---|
| WO | WO-2002084160 | A1 | 10/2002 |
| WO | WO-2019095054 | A1 | 5/2019 |

* cited by examiner

CHEMICAL
LP SEA WATER
HP SEA WATER
LP HYD RETURN
HP HYD SUPPLY
ELECTRICAL CABLES
20
40
72
72
1 m3 I.B.C. STORAGE 44c
1 m3 I.B.C. STORAGE 44b
1 m3 I.B.C. STORAGE 44a
FROM Fig. 4B
78
78
32
80
30
74
71
78
78
1 m3 I.B.C. STORAGE 44d
1 m3 I.B.C. STORAGE 44e
1 m3 I.B.C. STORAGE 44f
72
72
40

SUBSEA AUTONOMOUS CHEMICAL INJECTION SYSTEM

TECHNICAL FIELD

The disclosure relates, in general, to hydrocarbon production, and more particularly, to subsea facilities utilized in the production of hydrocarbons. Most particular, the disclosure relates to a subsea chemical injection skid system and method for injection of chemicals in subsea hydrocarbon production facilities.

BACKGROUND

Subsea systems for the production of hydrocarbons such as oil and gas require injection of various chemicals into production facilities such as subsea pipelines and wells. The chemicals typically improve production capacity and/or inhibit against corrosion, wax, asphaltene, hydrates, scale or other issues.

Normally the chemical injection system is incorporated into the design of the production facility and is installed and operated as an integral part of the production facility. Chemicals are typically pumped from a surface facility such as a floating production vessel, offshore platform, or onshore plant, through an umbilical system, entering the subsea system at the wellhead, pipeline end termination (PLET) subsea manifold or other apertures.

Some production facilities require subsea chemical injection in addition to the installed facilities or injection of specialized chemicals, which cannot be injected from surface through a long umbilical. Moreover, in various subsea pumping operations, such as subsea pipeline pre-commissioning, maintenance or other subsea pumping operations into wells or pipelines or wells, it is becoming increasingly common to inject chemicals into the pipelines or wells. Chemical dosage rates may vary significantly depending on the operation and can be as low as 0.0004 litres/minute, chemical volumes which are very difficult to achieve consistently and accurately. This is particularly true where there the volume of pumped seawater into which the chemical is injected are significantly higher than the volume of pumped chemical. For example, seawater may be pumped at a rate of 2200 litres/minute. It will be appreciated that in these systems, due to the significantly different volumes, the pumps themselves may be significantly different in size and type, rendering it that much more difficult to coordinate chemical pumps and their corresponding injection rates with seawater pumps and their corresponding flow volumes. Such systems are typically controlled remotely either through a remotely operated vehicle (ROV) or via an umbilical extending from the water's surface. Because chemical injection systems are operated remotely at or near the seabed, it is difficult to accurately monitor and control the dosage of chemicals.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Disclosed herein are embodiments of a subsea chemical injection assembly which monitors the flow of each of seawater and chemical pumped by the assembly, and automatically adjusts the flowrate of the chemical to maintain a desired chemical to seawater proportion over a wide range of seawater flow rates. The subsea chemical injection assembly includes a seawater pump with an associated seawater volume flowmeter for measuring the flowrate of seawater pumped into a hydrocarbon production facility. The subsea chemical injection assembly also includes a chemical injection pump or valve with an associated chemical subsea mass flowmeter. All of these components may be carried on a skid. The chemical subsea mass flowmeter includes a Coriolis tube housed in a pressure vessel having an internal pressure of approximately atmospheric pressure or ambient pressure at sea level, namely approximately one atmosphere or 1.01325 bars. The subsea chemical injection assembly may be fluidically connected to the production facilities using a remotely operated vehicle (ROV). The subsea chemical injection assembly may also include a control system that can monitor the volume flow rate of the seawater and the mass flow rate of the chemical and adjust the mass flow rate of the injected chemical in a closed loop system through control of the chemical pump or valve.

In one or more embodiments, the subsea chemical injection assembly may include one or more tanks for storage of chemicals to be injected. As used herein, references to tanks include any chemical storage vessel. These tanks may be carried on the same skid as the pumps and flowmeters or a separate skid.

The subsea chemical injection assembly may also include a seawater filtration system to filter the seawater before mixing with chemicals.

In one or more embodiments, the subsea chemical injection assembly may include multiple subsea mass flowmeters as described above, each subsea mass flowmeter used in association with the injection of a chemical.

In other embodiments, the chemical subsea mass flowmeter and chemical injection process pump may be mounted on a separate skid attached to an ROV or integrally mounted as part of a subsea pumping installation.

Figure 1:
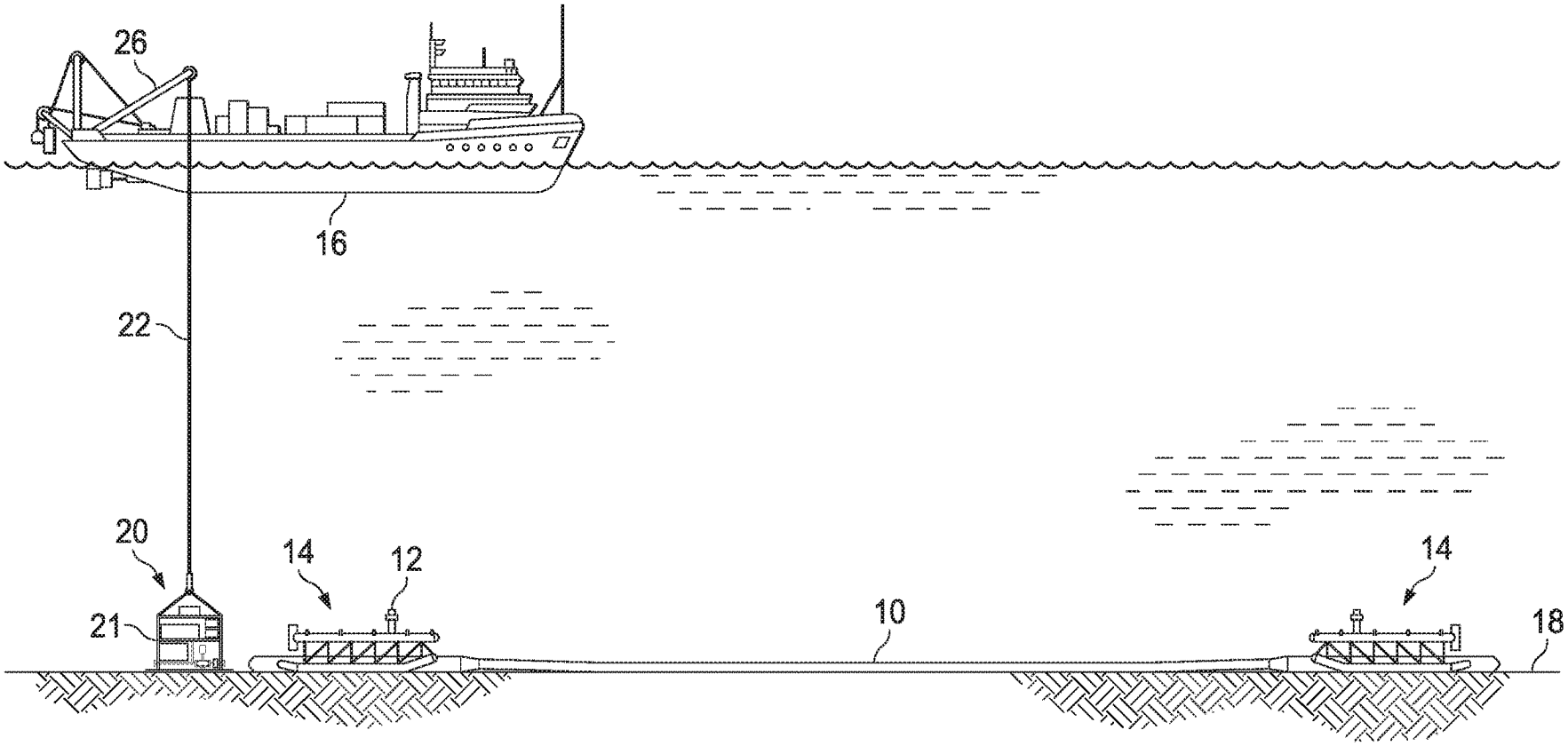
FIG. 1 is a schematic view of subsea chemical injection system deployed from a vessel to carry out chemical injection in subsea hydrocarbon production facilities on the seabed.

Turning to FIG. 1, a host facility 16 may be positioned above a subsea hydrocarbon production facility 10. A chemical injection system 20 be launched from the host facility 16 and lowered to a location on the sea floor 18 near a chemical injection point of the hydrocarbon production facility 10, such as a wellhead or subsea manifold. In this regard, the chemical injection system 20 may be stand-alone or form part of a subsea pigging and hydrostatic testing unit (SPHU), a subsea chemical storage and injection unit or some other subsea pumping skid or seabed pumping system. As used herein, hydrocarbon production facility 10 may generally refer to any subsea system used in the production of hydrocarbons, including any one or more of the wellbore, downhole equipment, wellhead, manifolds, pipelines, or risers. As used herein, host facility 16 may include a platform on the surface, a floating vessel, a floating production storage and offloading (FPSO) unit or an onshore system. Likewise, as used herein, manifold is used as a generic term to refer any wellhead trees, pipeline end manifolds (PLEMs), and pipeline end terminators (PLETs), to name a few, to carry out chemical injection. In any event, in the illustrated embodiment, chemical injection system 20 is lowered by cable 22 to a location adjacent an injection point 12 of the hydrocarbon production facility 10. In FIG. 1, a hydrocarbon production facility 10 is a deep-water pipeline which lies on or near the sea floor 18 between manifolds, such as PLEMS 14, either of which may be chemical injection point 12. In one or more embodiments, chemical injection system 20 comprises a non-buoyant structure 21, the weight of which is supported by cable 22. In some embodiments, non-buoyant structure 21 may include a metal frame that functions as a platform to support a chemical injection pump, a chemical subsea mass flowmeter, a seawater pump and a seawater volume flowmeter. Additionally, the frame may support chemical metering control equipment, such as a controller electrically connected to the chemical subsea mass flowmeter and the seawater volume flowmeter. Likewise, the frame may support one or more chemical tanks. The cable 22 may be an umbilical cord that can provide, either alone or in combination with other power sources, electric current for electric motors(s) or hydraulic power to drive the chemical injection system 20. In some embodiments, cable 22 is a crane wire deployed from host facility 16 and which cable 22 may be disconnected from the non-buoyant structure 21 once it is positioned on the sea floor 18. In other embodiments, cable 22 is an integral component of non-buoyant structure 21, where integral cable 22 may be used for one or more of deployment, recovery, supply of electrical or hydraulic power, control, feedback and monitoring.

In some embodiments, because of the weight of the chemical tanks and the length of many chemical injection operations, it will be appreciated that it may be undesirable to suspend chemical injection system 20 from cable 22 during pumping operations. Thus, chemical injection system 20 may be positioned on sea floor 18 near the chemical injection point 12 of hydrocarbon production facility 10. However, in other more abbreviated chemical injection operations, chemical injection system 20 may be suspended above sea floor 18 in the vicinity of the chemical injection point 12 of hydrocarbon production facility 10, either on cable 22 or by an ROV (see FIG. 2A).

Again, in one or more embodiments, chemical injection system 20 may comprise a non-buoyant structure 21 which may include a metal frame that one or more chemical injection pumps, a chemical subsea mass flowmeter, a seawater pump and a seawater volume flowmeter. Additionally, the frame may support chemical metering control equipment, such as a controller electrically connected to the chemical subsea mass flowmeter and the seawater volume flowmeter. The cable 22 may be an umbilical cord that can provide, either alone or in combination with other power sources, electric current for the electric motor(s) or hydraulic power to drive the chemical injection system 20.

Figure 2A:
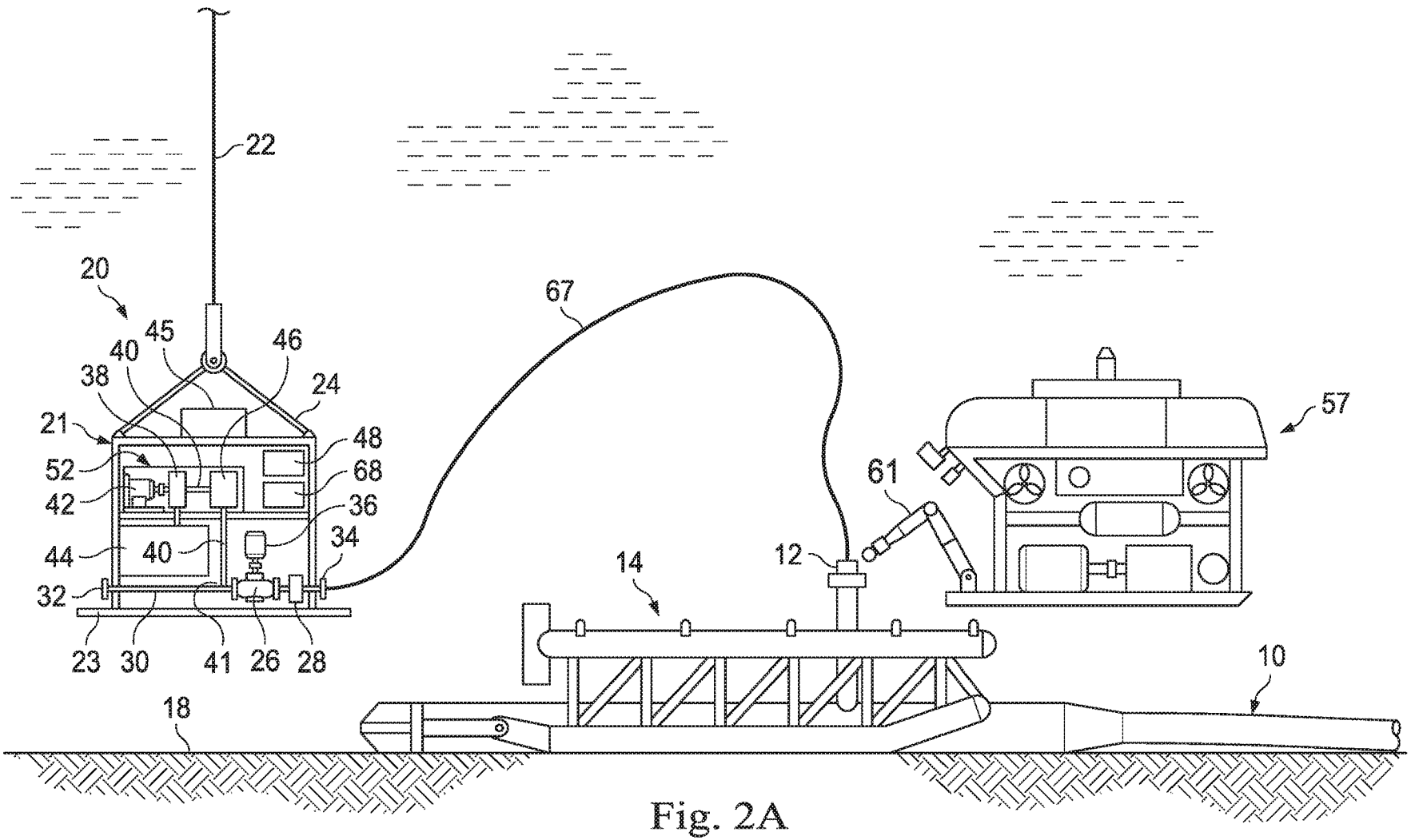
FIG. 2A is a schematic view of a subsea chemical injection system connected to a subsea hydrocarbon production facility by a remote operated vehicle to carry out chemical injection in subsea hydrocarbon production facilities on the seabed.

Turning to FIG. 2A, chemical injection system 20 is illustrated as being lowered by a cable 22 to a location adjacent a hydrocarbon production facility 10, and in particular, adjacent PLEM 14, which is illustrated as a chemical injection point 12. Chemical injection system 20 is designed specifically for injection of chemicals to enhance hydrocarbon production. In the illustrated embodiment, chemical injection system 20 is portable (as opposed to part of a fixed subsea installation) and includes a skid 23 having a frame 24. Skid 23 may be non-buoyant. The frame 24 supports one or more process seawater pumps 26 for pumping seawater to the hydrocarbon production facility 10. Seawater pumps 26 may include a high-pressure pump, such as may be used for hydrostatic testing; and/or a low-pressure pump, such as may be used for flooding and pigging operations; or a combination of any of these pumps. In some embodiments, seawater pumps 26 include both a high-pressure pump for high-pressure pumping operations and a low-pressure pump for low pressure pumping operations. As used herein, a high-pressure pump is a pump capable of pumping seawater at least at a pressure of 1,000 psi, although such high-pressure pumping pressures may reach 10,000 psi, or 15,000 psi, or 20,000 psi or 25,000 psi or more.

In this embodiment, frame 24 also supports a seawater volume flowmeter 28 disposed to measure a volume of seawater pumped by seawater pump 26. In this regard, seawater pump 26 and seawater volume flowmeter 28 are each disposed along a seawater flowline 30 which may generally have a seawater flowline inlet 32 and a first seawater flowline outlet 34. In one or more embodiments, seawater volume flowmeter 28 may be positioned along seawater flowline 30 between seawater pump 26 and seawater flowline outlet 34. In other embodiments, seawater volume flowmeter 28 may be positioned along seawater flowline 30 between seawater pump 26 and seawater flowline inlet 32. Although seawater volume flowmeter 28 is not limited to any particular type of flowmeter, in one or more embodiments, seawater volume flowmeter 28 may be a turbine, magnetic flux, ultrasonic flowmeter. In other embodiments, seawater volume flowmeter 28 may be replaced with a subsea mass flowmeter as described below. In any event, seawater pump 26 may be driven by pump motor 36, which may be hydraulic, electric or the like.

Frame 24 is also shown supporting one or more chemical injection flow control mechanisms 38 for introducing a chemical into seawater flowline 30. In one or more embodiments, chemical injection flow control mechanism 38 may be a process pump such as a gear pump or a piston pump with variable speed that can be adjusted or moderated to control the volume/flowrate of pumped chemical. In other embodiments, chemical injection flow control mechanism 38 may be a chemical control valve which can be adjusted between an opened and a closed position to regulate volume of chemical introduced into seawater flowline 30. In this regard, chemical injection flow control mechanism(s) 38 is disposed along a chemical flowline 40 which is in fluid communication with seawater flowline 30. In some embodiments, chemical flowline 40 is in fluid communication with seawater flowline 30 upstream of seawater pump(s) 26, while in other embodiments, chemical flowline 40 is in fluid communication with seawater flowline 30 downstream of seawater pump(s) 26. Similarly, seawater volume flowmeter 28 may be positioned along seawater flowline 30 between seawater pump 26 and seawater flowline outlet 34 (downstream of seawater pump(s) 26), while in other embodiments, seawater volume flowmeter 28 may be positioned along seawater flowline 30 between seawater pump 26 and seawater flowline inlet 32 (upstream of seawater pump(s) 26). Likewise, seawater volume flowmeter 28 may be positioned along seawater flowline 30 either upstream or downstream of chemical flowline 40. In any event, chemical injection flow control mechanism 38 may be driven by motor 42, which may be hydraulic, electric or the like.

Chemical flowline 40 also may be in fluid communication with a chemical source 44. In some embodiments, chemical source 44 may be a chemical storage tank carried by frame 24 or otherwise disposed adjacent frame 24. In other embodiments, chemical source 44 may be an umbilical 22 or ROV 57. In some embodiments, chemical source 44 may be a chemical storage tank carried in an installation on the seabed. Chemical source 44 may provide a chemical selected for a particular chemical injection task or operation, such to improve production capacity, to treat or inhibit against corrosion; to treat or inhibit wax; to inhibit asphaltene; to inhibit hydrates; to treat or inhibit scale. In one or more embodiments, two different chemicals or formulations for any one such task may be deployed in separate tanks 44.

Finally, frame 24 also supports one or more chemical subsea mass flowmeters 46. In one or more embodiments, chemical subsea mass flowmeter 46 may be disposed along the chemical flowline 40 between chemical injection flow control mechanism 38 and the junction 41 to seawater flowline 30. Where chemical injection flow control mechanism 38 is a controllable valve, chemical subsea mass flowmeter 46 may be disposed along the chemical flowline 40 either upstream or downstream of the valve.

Frame 24 may also support one or more power units 48 which may include one or more pump motors 36, 42, such as an electrical motor, a hydraulic motor or both, for driving seawater pump 26 and/or chemical injection flow control mechanism 38. Pump motors 36, 42 may be driven by line 22, or by ROV 57, or by a local power source 45, such as a battery or generator(s) or hydraulic accumulator(s). Line 22 may be an electric umbilical for delivering current to power unit 48. Line 22 may be a hydraulic conduit for delivering a hydraulic fluid to power unit 48. Line 22 may include both an electrical line and a hydraulic conduit.

In the illustrated embodiment, an ROV 57 may be utilized to fluidically couple an injection line 67 between chemical injection system 20 and an injection point 12 of hydrocarbon production facility 10. ROV 57 is shown having a manipulator arm 61 for facilitating connection of injection line 67 to hydrocarbon production facility 10.

While chemical injection system 20 is described above as including a skid 23 having a frame 24, in other embodiments, the components of the chemical injection system 20, namely the seawater pump(s) 26, the seawater volume flowmeter(s) 28, the chemical injection flow control mechanism(s) 38, and the chemical subsea mass flowmeter(s) 46 may be assembled as part of a more fixed or permanent subsea installation. In this regard, any one or more of the components of the chemical injection system 20 may be separately carried or supported on a skid, ROV 57 or the like so long as these components operate together as described herein. In one or more embodiments, ROV 57 may be utilized to carry skid 23 on which chemical injection system 20 is mounted.

Figure 2B:
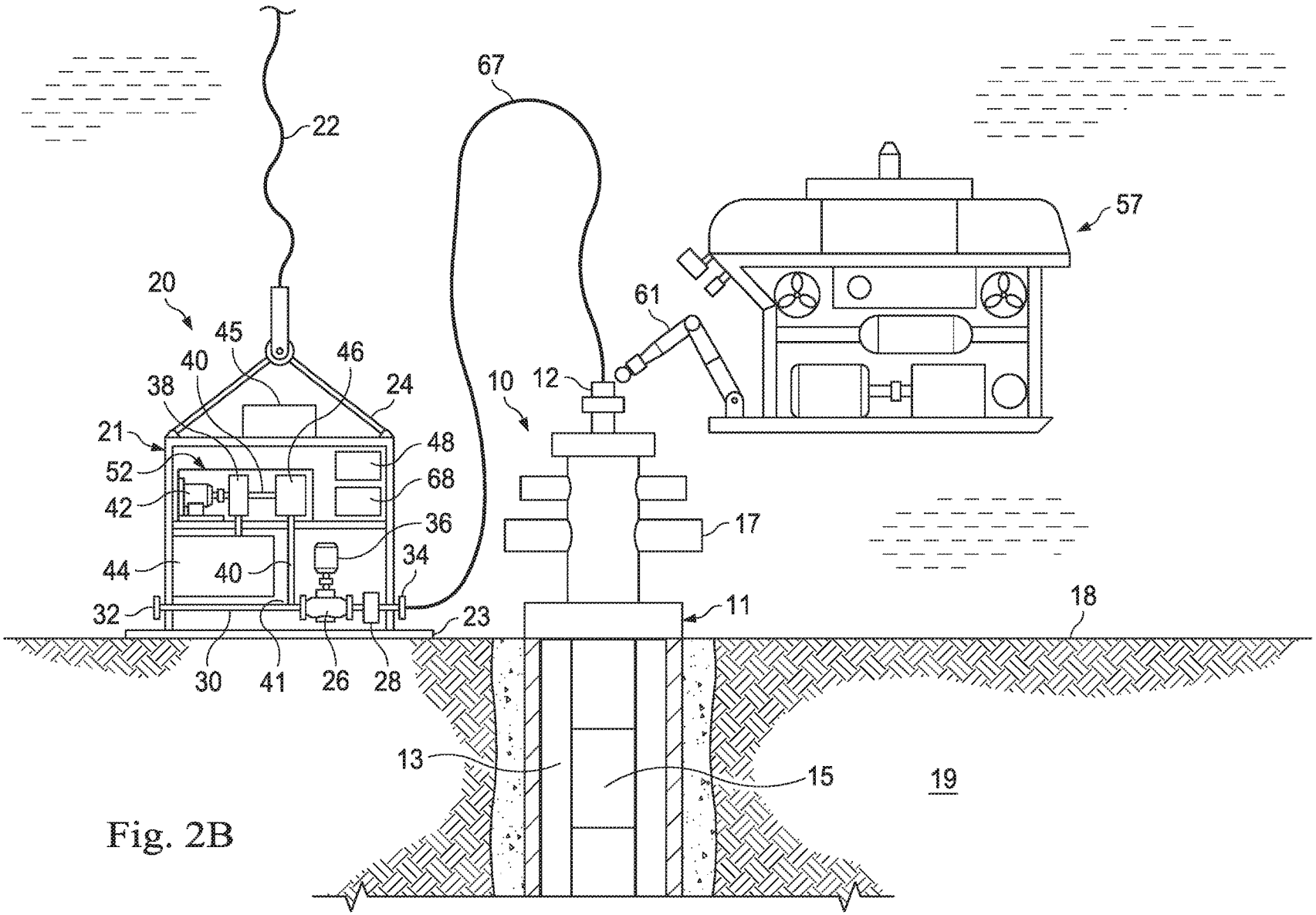
FIG. 2B is a schematic view of a chemical injection system connected to a subsea hydrocarbon production facility by a remote operated vehicle to carry out chemical injection in subsea hydrocarbon production facilities within a wellbore.

FIG. 2B is similar to FIG. 1A, but in FIG. 2B production facility 10 is shown as a wellhead 11 positioned over a wellbore 13 with production equipment 15 deployed therein. Wellhead 11 may include blowout preventers 17 or other equipment. Production equipment 15 is not limited by the disclosure, but will be understood to be any equipment deployed in wellbore 13 to facilitate production of hydrocarbons from formation 19, including, without limitation, pumps, upper production equipment and/or lower production equipment. In the illustrated embodiment, wellhead 11 is a chemical injection point 12 for production facility 10.

Figure 3:
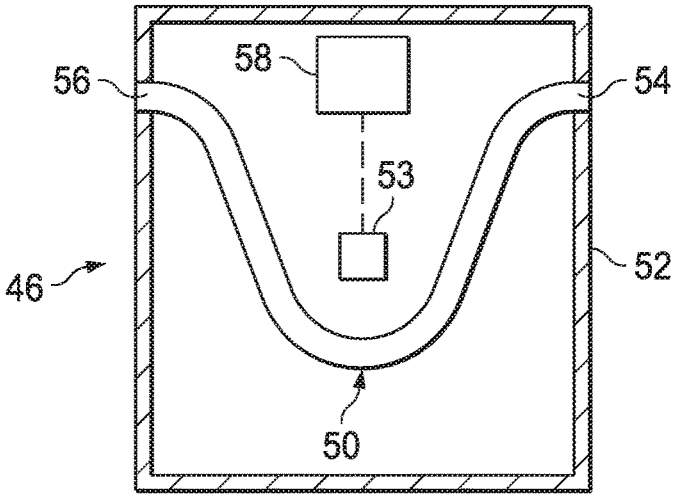
FIG. 3 is a subsea mass flowmeter of a chemical injection system.

Turning to FIG. 3, one embodiment of a chemical subsea mass flowmeter 46 is illustrated. Chemical subsea mass flowmeter 46 includes a Coriolis tube 50 disposed in a pressure vessel 52 having a mass flowmeter inlet 54 and a mass flowmeter outlet 56. Also shown within pressure vessel 52 is a Coriolis tube measurement mechanism 53 disposed to measure a characteristic or condition of Coriolis tube 50 when a chemical is flowing therethrough. For example, Coriolis tube measurement mechanism 53 may be one or more sensors disposed to measure a frequency of Coriolis tube 50 when a chemical is flowing therethrough. In one or more embodiments, pressure vessel 52 may be a pressure housing sealed at an internal pressure of approximately atmospheric pressure or ambient pressure at sea level, namely approximately one atmosphere or 1.01325 bars. In one or more embodiments, pressure vessel 52 may be a pressure housing having an external pressure resistance of at least 100 bars, i.e. a nominal pressure rating of at least 100 bars. In one or more embodiments, pressure vessel 52 may be a pressure housing having an external pressure resistance of at least 150 bars, i.e. a nominal pressure rating of at least 150 bars. In one or more embodiments, pressure vessel 52 may be a pressure housing having an external pressure resistance of at least 200 bars, i.e. a nominal pressure rating of at least 200 bars. In one or more embodiments, pressure vessel 52 may be a pressure housing having an external pressure resistance of at least 300 bars, i.e. a nominal pressure rating of at least 300 bars. In one or more embodiments, pressure vessel 52 may be a housing having an external pressure resistance of at least 3000 meters of seawater. In one or more embodiments, pressure vessel 52 may be formed of corrosion resistant alloy.

Pressure vessel 52 may also house amass flowmeter controller 58 which may be utilized to monitor the output of chemical subsea mass flowmeter 46 and adjust an associated chemical injection flow control mechanism 38. In this regard, mass flowmeter controller 58 may be electrically coupled to Coriolis tube measurement mechanism 53 and an electric pump motor 42 housed within pressure vessel 52.

Figure 4A:
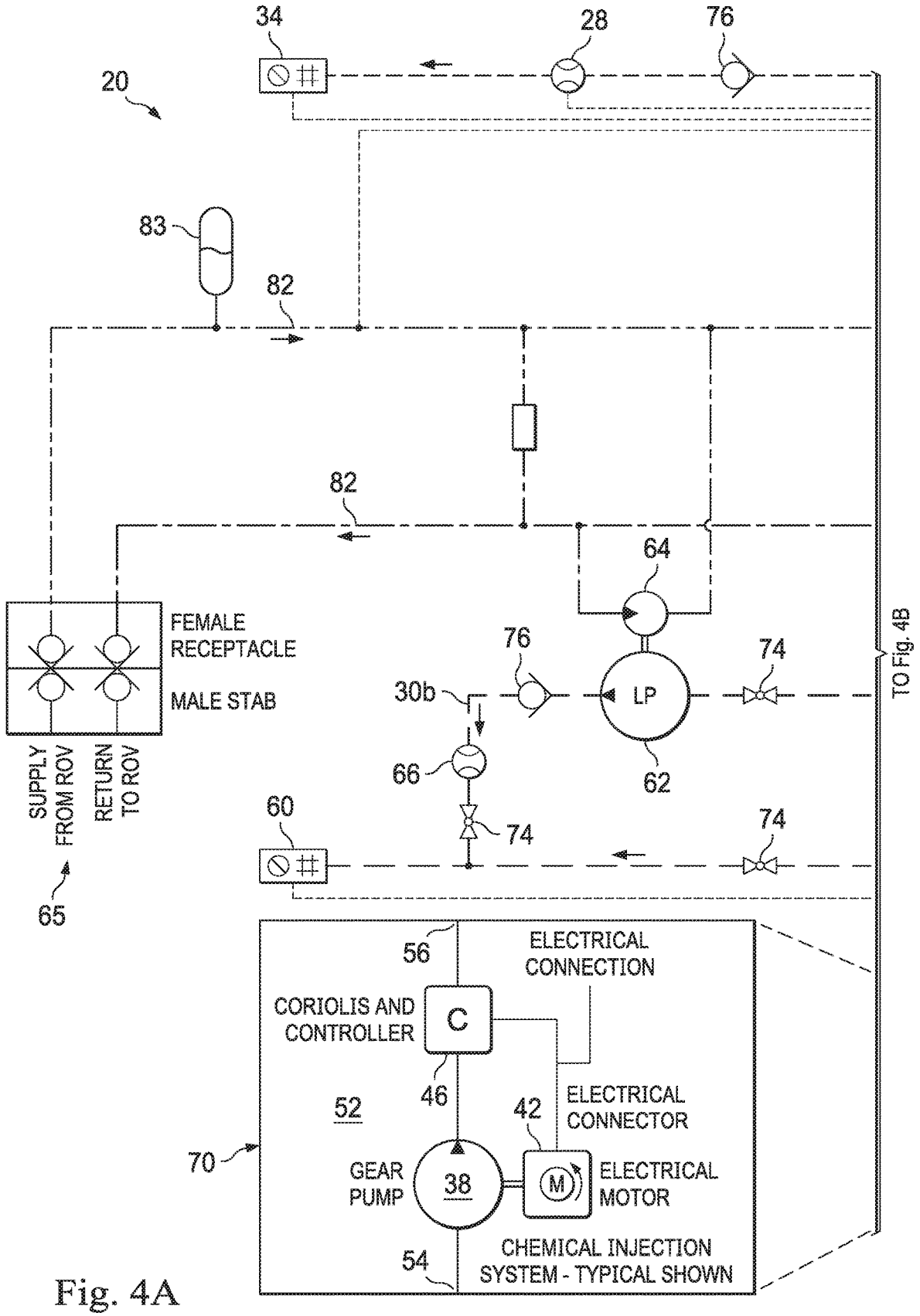
FIGS. 4A, 4B and 4C show a schematic of a subsea chemical injection system.
Figure 4B:
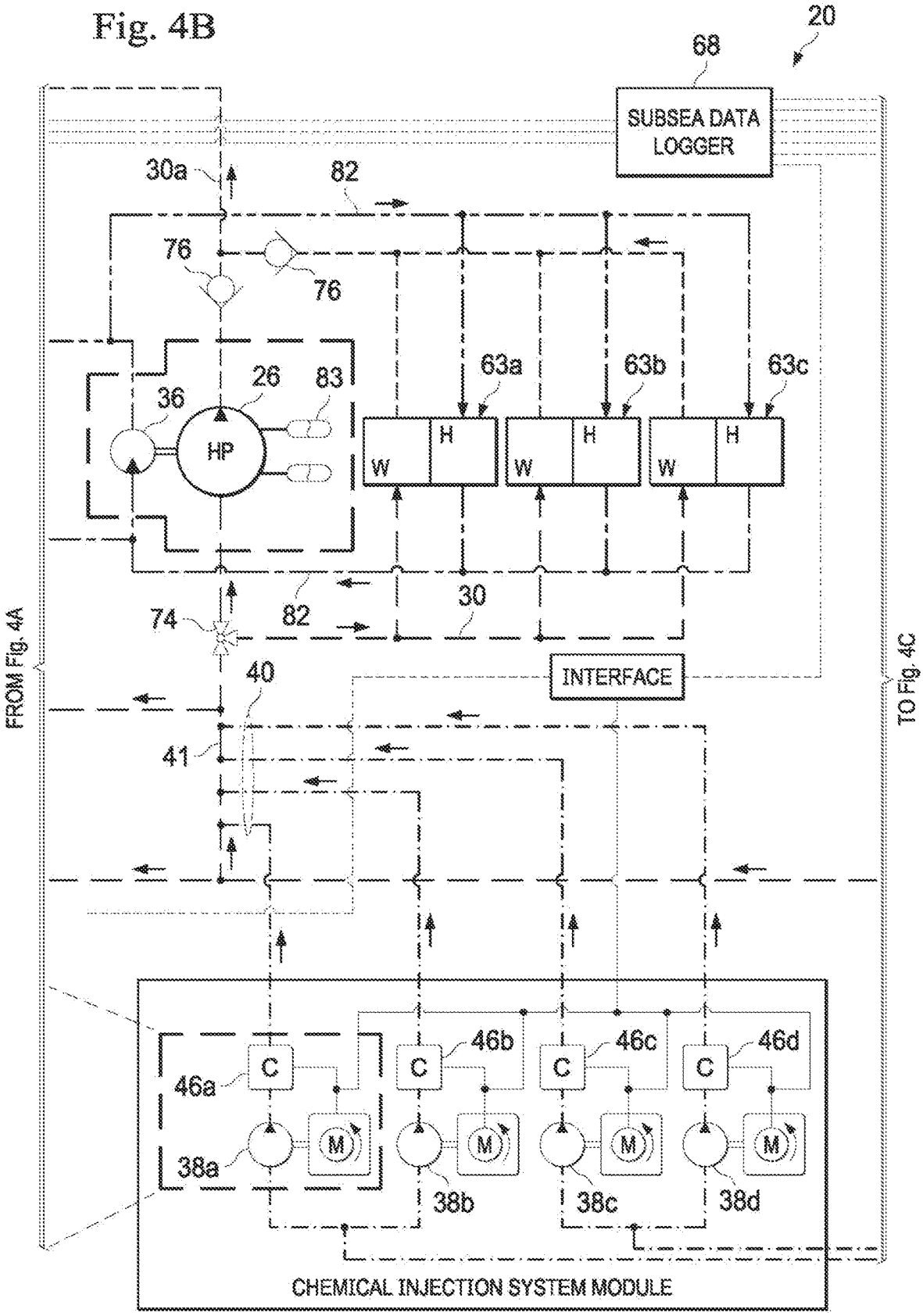
Figure 4C:
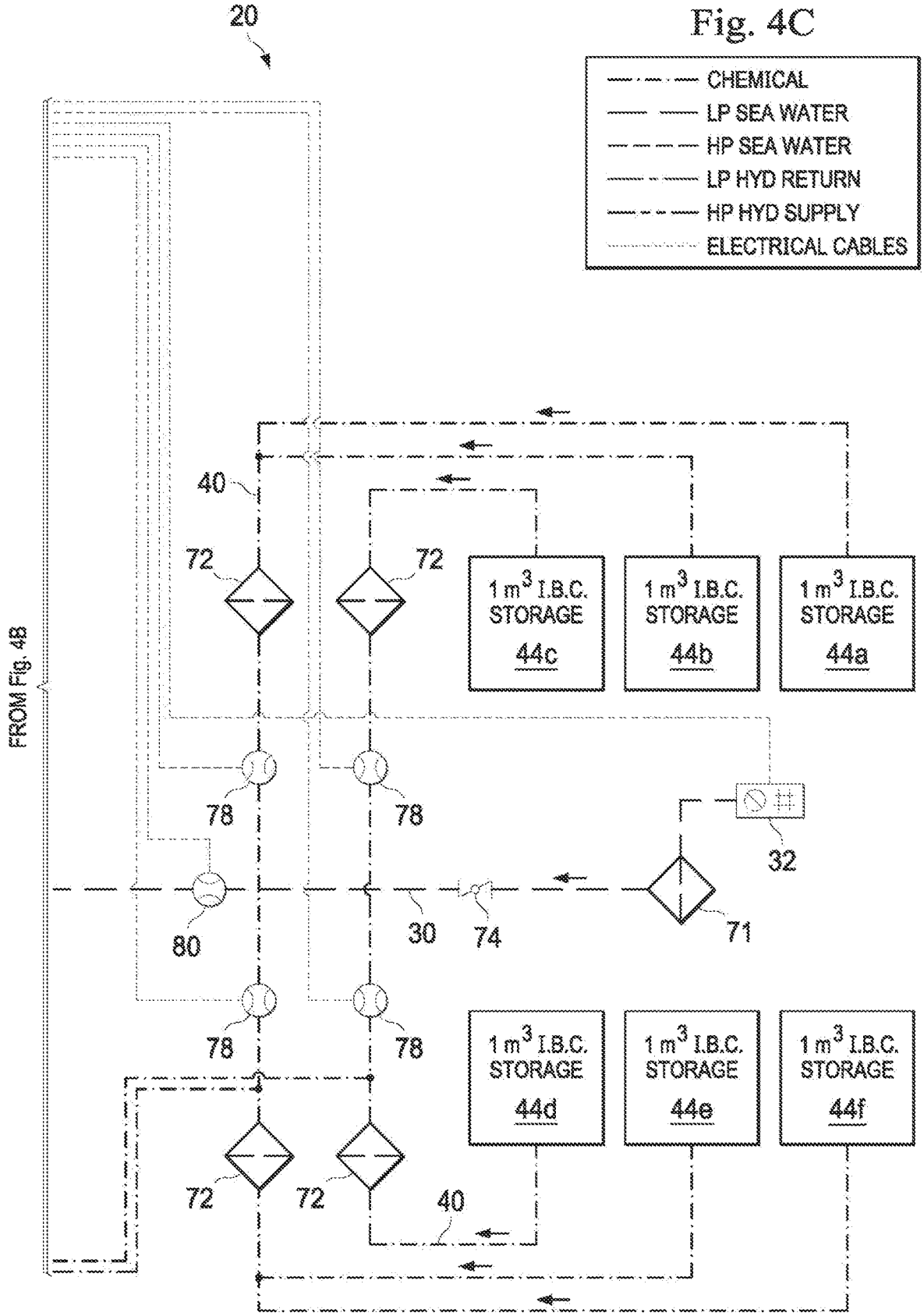

FIGS. 4A, 4B and 4C represent a schematic of chemical injection system 20. In this illustrated embodiment, seawater flowline 30 extends from a seawater flowline inlet 32 to a seawater flowline outlet 34. In the illustrated embodiment, seawater flowline outlet 34 is an outlet downstream of seawater pump 26. In the illustrated embodiment, seawater pump 26 is a high-pressure pump and seawater flowline outlet 34 is a high-pressure outlet. Also shown in FIGS. 4A, 4B and 4C is a low-pressure seawater flowline outlet 60 downstream of a seawater pump 62, where seawater pump 62 is a low-pressure pump disposed along a low-pressure portion 30*b* of seawater flowline 30 in fluid communication with a low-pressure seawater flowline inlet 32.

Seawater pump 26 is driven by hydraulic pump motor 36, while seawater pump 62 is driven by hydraulic motor 64. In one or more embodiments, hydraulics for operation of motors 36, 64 may be provided by an ROV (see FIG. 2) via a hot-stab connector 65.

In addition to high-pressure seawater pump 26, in one or more embodiments, one or more additional pressurization pumps 63 may be included along seawater flowline 30, such as the hydraulic pressurization pumps shown as pressurization pumps 63*a*, 63*b* and 63*c*, showing seawater entering at subsea pressure and exiting at a higher pressure into the high-pressure portion of seawater flowline 30. Along with seawater pump 26, pressurization pumps 63 permit a range of higher pressures to be achieved by chemical injection system 20.

A seawater volume flowmeter 28 is shown positioned along seawater flowline 30 along a high-pressure portion 30*a* between seawater pump 26 and seawater flowline outlet 34. Likewise, a seawater volume flowmeter 66 is shown positioned along a low-pressure portion 30*b* of seawater flowline 30 between seawater pump 62 and seawater flowline outlet 60.

In the illustrated embodiment, chemical source 44 for chemical injection system 20 is shown as a plurality of chemical storage tanks, namely chemical storage tanks 44*a*, 44*b*, 44*c*, 44*d*, 44*e* and 44*f*. Each chemical storage tank 44*a*-44*f* includes a chemical flowline 40 in fluid communication with a chemical injection flow control mechanism 38. In the illustrated embodiment, chemical injection flow control mechanism 38 are shown as chemical injection process pumps 38 and will be referred to as pumps in FIGS. 4A, 4B and 4C. However, it will be understood that chemical injection process pumps 38 may also refer to controllable valves in these embodiments.

In the illustrated embodiment, chemical injection system 20 has a plurality of chemical injection process pumps 38, namely chemical injection process pumps 38*a*, 38*b*, 38*c* and 38*d*. Although not limited to any particular configuration, in the illustrated embodiment, chemical injection process pumps 38*a* and 38*b* are in fluid communication with chemical storage tanks 44*a*, 44*b*, 44*e* and 44*f*. Chemical injection process pumps 38*c* and 38*d* are in fluid communication with chemical storage tanks 44*c* and 44*d*. In any event, associated with each chemical injection process pump 38 is a dedicated chemical subsea mass flowmeter 46, as indicated by chemical subsea mass flowmeters 46*a*, 46*b*, 46*c* and 46*d*. Referring back to FIG. 3, each chemical subsea mass flowmeter 46 includes a Coriolis tube 50 within a pressure vessel 52 having a mass flowmeter inlet 54 and a mass flowmeter outlet 56 in fluid communication with the Coriolis tube 50. It will be appreciated that pressure vessel 52 is sealed at an internal pressure of approximately atmospheric pressure or ambient pressure at sea level, i.e., approximately one atmosphere or 1.01325 bars, so that measurements of Coriolis tube 50 can be made at approximately sea level pressure. In addition to the Coriolis tube 50, each pressure vessel 52 may further include a mass flowmeter controller 58 to control operation of its associated chemical injection process pump 38 based on measurements made by seawater volume flowmeter 28 and measurements made by the chemical subsea mass flowmeter 46.

Each chemical injection process pump 38 may be driven by a motor 42, such as motors 42*a*, 42*b*, 42*c* and 42*d*. In one or more embodiments, each motor 42 may be an electric motor. In this regard, each motor 42 may be a variable speed motor, the speed of which is governed by a mass flowmeter controller 58. Thus, the operation of each chemical injection process pump 38, via its associated motor 42, can be governed by mass flowmeter controller 58 of the chemical subsea mass flowmeter 46. In one or more embodiments, the electric motor 42 and chemical injection process pump 38 associated with a chemical subsea mass flowmeter 46 may also be sealed in pressure vessel 52, such as is shown in FIGS. 4A, 4B and 4C, to form a chemical subsea mass flowmeter system 70.

In one or more embodiments, a plurality of chemical subsea mass flowmeters 46 may be housed in a single pressure vessel 52. For example, a pressure vessel 52 may have two, three, four or more Coriolis tubes 50 within the pressure vessel 52, along with a separate chemical injection process pump 38 for each Coriolis tubes 50 housed within the pressure vessel 52. In other embodiments, a pressure vessel 52 may house a plurality of Coriolis tubes 50 within the pressure vessel 52, along with a separate chemical injection process pump 38 for each of the Coriolis tubes 50. Additionally, in some embodiments, a separate mass flowmeter controller 58 to control operation of its associated chemical injection process pump 38 may be housed within the pressure vessel 52. In such case, the pressure vessel 52 may include two or more chemical inlets 54, each in fluid communication with one or more chemical sources 44, and one or more chemical outlets, each in fluid communication with the seawater flowline 30. In any event, as illustrated in FIGS. 4A, 4B and 4C, in this arrangement, a chemical inlet 54 directs chemical flow into the pressure vessel 52, and specifically, to a chemical injection process pump 38, which then directs the chemical flow through an associated Coriolis tube 50. After passing through the Coriolis tube 50, the chemical flow is directed out of the pressure vessel 52 via chemical outlet 56.

In addition to each mass flowmeter controller 58, chemical injection system 20 may further include a system controller 68 electrically coupled to seawater volume flowmeter 28, as well as to each individual mass flowmeter controller 58 and each mass flowmeter motor 42. System controller 68 may also be housed in one of the pressure vessels 52 of a chemical subsea mass flowmeter 46. System controller 68 may function as a data logger which monitors and records information in regard to seawater and chemical flowrates, ratios, pump rates, pressures, chemical viscosity changes due to temperature and other parameters. This information may be monitored real time and recorded for recovery and analysis. In any event, system controller 68 permits chemical injection system 20 to function as a closed loop control system, obviating the need for input or control from a surface vessel such as host facility 16 (see FIG. 1). Rather, system controller 68, or a flowmeter controller 58 may be provided with a chemical dosing setpoint, and chemical injection process pump(s) 38 may be operated to maintain the preselected setpoint regardless of flow fluctuations of seawater passing through chemical injection system 20. Thus, in one or more embodiments, one or more of the controllers 58, 68 may include a software program disposed, based on the setpoint, to automatically adjust operation of the chemical injection process pump(s) 38 or chemical control valve(s) based on a comparison of the seawater flow volume measured by seawater volume flowmeter 28 and the chemical subsea mass flowmeter 46.

A seawater filtration system 71 may be positioned along seawater flowline 30. In one or more embodiments, seawater filtration system 71 is positioned adjacent seawater inlet 32 and may include one or more filters for filtering seawater as it flows into seawater flowline 30. Similarly, chemical filtration systems 72 may be placed along one or more of chemical flowlines 40 between chemical source 44 and chemical injection process pump 38. Chemical filtration system 72 may include one or more filters for filtering a chemical prior to flowing through subsea mass flowmeters 46.

Valves 74 may be positioned along seawater flowline 30 to direct seawater flow to high-pressure seawater pump 26, low-pressure seawater pump 62, or pressurization pumps 63. Likewise, check valve 76 may be positioned downstream of one or more of the high-pressure seawater pump(s) 26, low-pressure seawater pump(s) 62, or pressurization pump(s) 63.

In addition to volume flowmeters positioned downstream of a pump, such as seawater volume flowmeters 28 and 66, in one or more embodiments, volume flowmeter(s) 78 may be positioned along chemical flowline 40 to measure chemical flow volume prior to entering a chemical injection process pump 38. Likewise, a seawater volume flow meter 80 may be positioned along seawater flowline 30 to measure the volume of seawater flowing to the seawater pump(s). In any of these instances, but particularly along the chemical flowline(s) 40 where chemical flow volumes may be comparatively low in relation to seawater flow into seawater inlet 32, the volume flowmeter(s) 78 may be replaced with subsea mass flowmeters as described herein.

Finally, in one or more embodiments where components of chemical injection system 20 are hydraulically driven, such as may be the case with pump motors 36, 64 and pressurization pumps 63, hydraulic lines 82 extending to such components from hot-stab connector 65 may include one or more hydraulic accumulators 83 as shown.

It will be appreciated that the volume of chemical injected into the seawater utilizing the chemical injection system 20 may vary significantly from the volume of the seawater itself. In this regard, the size of seawater flowline 30 may vary significantly from the size of chemical flowline 40, given the disparities in the comparable volumes of chemical versus seawater. Thus, in some embodiments, the seawater flowline 30 has a first diameter D1 and the chemical flowline 40 has a second diameter D2, wherein the second diameter D2 is less than the first diameter D1. In some embodiments, the first diameter D1 is at least 4 inches and the second diameter D2 is no more than 0.5 inches. In some embodiments, the ratio of the first diameter D1 to the second diameter D2 is no less than 8:1. In any event, it will be appreciated that the seawater volume flowmeter 28 is selected as a flowmeter capable of measuring a high volume of seawater flowing therethrough, whereas the chemical flowmeter 46 is selected as a flow meter capable of more precisely measuring a low volume of chemical flowing therethrough.

Figure 5:
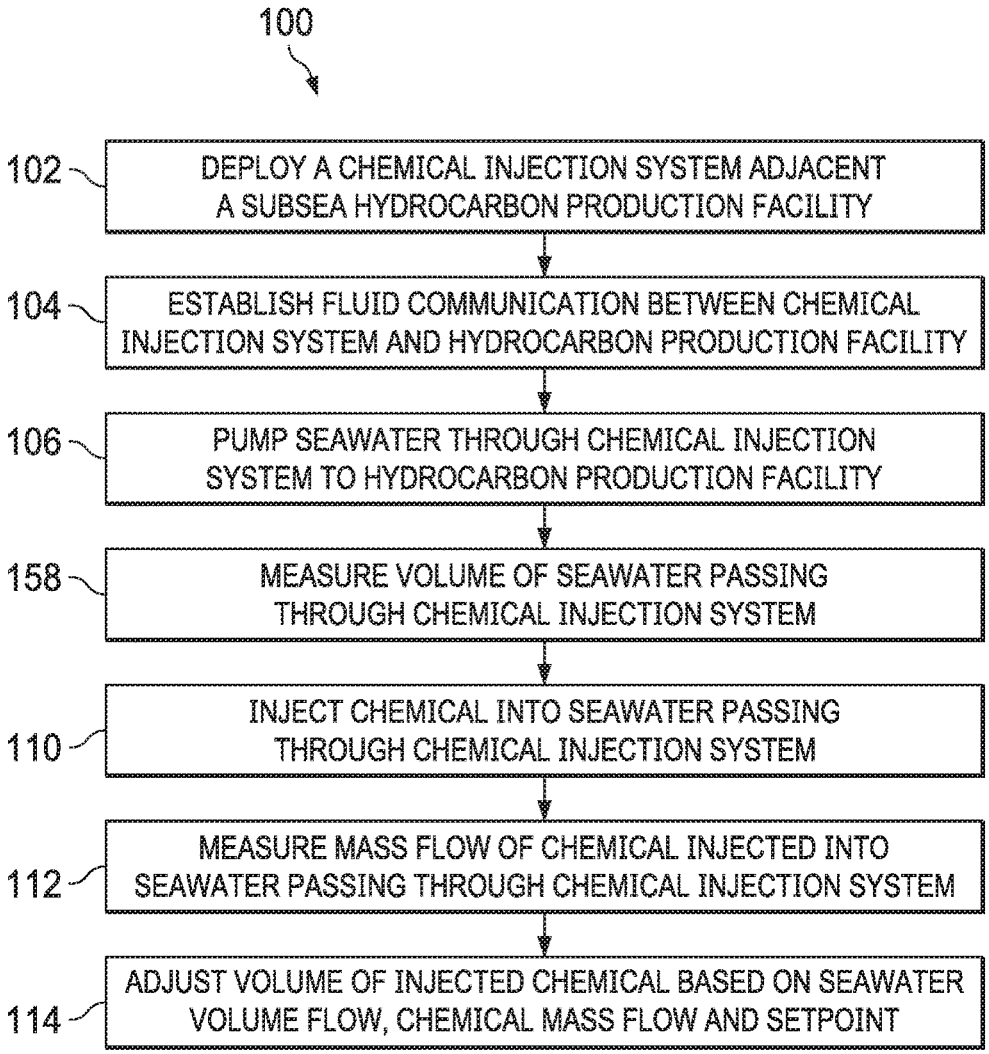
FIG. 5 illustrates a method for injecting chemicals into a subsea hydrocarbon production facility.

In operation, a method 100 for injecting chemicals into a subsea hydrocarbon production facility is illustrated in FIG. 5. In a first step 102, a chemical injection system 20 is deployed adjacent a subsea hydrocarbon production facility. In some embodiments, the subsea hydrocarbon production facility may be at a depth of 100 meters or more, while in other embodiments, the subsea hydrocarbon production facility may be at a depth of 1000 meters or more, while in other embodiments, subsea hydrocarbon production facility may be at a depth of 2000 meters or more. In each case, it will be appreciated that the seawater pressure at the depth of the subsea hydrocarbon production facility is significantly greater than sea level atmospheric pressure.

Chemical injection system 20 deployed in first step 102 includes at least one seawater pump 26, at least one seawater volume flowmeter 28, at least one chemical injection flow control mechanism 38 and at least one chemical subsea mass flowmeter 46. The subsea mass flowmeter 46 includes a Coriolis tube 50 housed in a pressure vessel 52, which may also house the chemical injection flow control mechanism 38, as well as a mass flowmeter controller 58 and a system controller 68. The pressure vessel 52 has an internal pressure of approximately one atmosphere or 1 bar. In other words, Coriolis tube 50 has an external ambient pressure of approximately one atmosphere or 1 bar. In one embodiment, a hydraulic pump motor 36 drives seawater pump 26 and an electric motor 42 drives chemical injection flow control mechanism 38. Chemical injection system 20 may also include a chemical source 44. In one or more embodiments, one or more of the foregoing components may be carried on a skid 23, in which case, skid 23 is lowered on a line 22 or otherwise carried by an ROV 57 to deploy chemical injection system 20 adjacent a subsea hydrocarbon production facility 10. The skid 23 may be placed on the seabed or suspended over the seabed. In any event, it will be appreciated that the pressure of the seawater is tens or hundreds of bars greater than the internal pressure of pressure vessel 52.

In a second step 104, the chemical injection system 20 is attached to hydrocarbon production facility 10 to establish fluid communication between the chemical injection system 20 and the hydrocarbon production facility 10. In one or more embodiments, an ROV 57 may be used to fluidically couple the chemical injection system 20 and the hydrocarbon production facility 10. The ROV 57 may couple an injection line 67 between injection point 12 of hydrocarbon production facility 10 and seawater flowline outlet 34 and/or seawater flowline outlet 60. It will be appreciated that second step 104 is only necessary when chemical injection system 20 is positioned adjacent hydrocarbon production facility 10 on a skid that is lowered or otherwise transported to hydrocarbon production facility 10. In other embodiments, chemical injection system 20 may be integrated into a more permanent or fixed installation (not shown), obviating the need for second step 104, as well as first step 102.

In step 106, seawater is pumped through chemical injection system 20 to a hydrocarbon production facility 10. Specifically, a seawater pump 26 and/or seawater pump 62 is operated to draw seawater into chemical injection system 20 via seawater inlet 32 and along a seawater flowline 30. The seawater may be passed through a seawater filtration system 71. Seawater drawn into chemical injection system 20 may also be measured with an upstream seawater volume flowmeter 80, which measurement may be prior to injection of chemicals into the seawater flow stream. The seawater is subsequently pumped from chemical injection system 20 through seawater flowline outlet 34 or 60 to the hydrocarbon production facility 10. In one or more embodiments, the pumped seawater is used to flood the pipeline of a hydrocarbon production facility 10 prior to initiating injection of a chemical into the seawater. In other operations, seawater may be pumped to perform a pumping operation selected from the group consisting of hydrostatic testing operations, pigging operations, well stimulation, hydraulic fracturing operations, and chemical injection operations. In one or more embodiments, the seawater pump 26 may be utilized to pressurize the pumped seawater as a high-pressure pump. For example, the pumped seawater may be pressurized to 1000 psi or more by seawater pump 26.

In step 108, the volume of seawater passing through chemical injection system 20 is measured to determine a seawater flowrate. In one or more embodiments, the volume of seawater is measured downstream of the seawater pump 26 or 62 as the case may be, to determine a seawater flowrate exiting the chemical injection system 20. In one or more embodiments, the seawater is measured after a chemical has been injected into the seawater by chemical injection system 20. The volume of seawater may be measured using a seawater volume flowmeter 28 (or 66) as described above. In any event, an output from the seawater volume flowmeter 28 (or 66) based on the measured seawater volume may be generated.

In step 110, one or more chemicals are injected into seawater passing through chemical injection system 20. The one or more chemicals may be drawn from one or more chemical sources 44. In some embodiments, at least two chemicals are injected into the seawater passing through chemical injection system 20, each of the two chemicals drawn from a separate chemical source 44. In one or more embodiments, a chemical may be injected by operating a chemical injection flow control mechanism 38 which can be selectively adjusted to control the volume of chemical passing through chemical injection flow control mechanism 38. In one or more embodiments, chemical injection flow control mechanism 38 may be a chemical injection process pump that is a positive displacement variable speed pump and the volume/flowrate of chemical pumped therethrough can be controlled by altering or moderating the pump speed. In other embodiments, chemical injection flow control mechanism 38 may be a controllable valve and the chemical may be injected by operating the valve which can be selectively adjusted to control the volume of chemical released through the valve.

In step 112, the mass flow of the chemical injected into the seawater passing through chemical injection system 20 is measured to determine a first chemical flowrate. The chemical mass flow may be measured by chemical subsea mass flowmeter 46 as described above. In one or more embodiments, the mass flow of the chemical is measured at a pressure less than the pressure of the seawater drawn into the chemical injection system 20. In one or more embodiments, the mass flow of the chemical is measured at ambient sea level pressure. In one or more embodiments, the mass flow of the chemical is measured at a pressure of approximately one atmosphere. In other words, the flow of chemical passing through Coriolis tube 50 housed within pressure vessel 52 is measured at an ambient pressure of approximately one atmosphere or 1 bar. In any event, an output from the chemical subsea mass flowmeter 46 based on the measured chemical may be generated.

In step 114, based on the output of the chemical subsea mass flowmeter and the seawater volume flowmeter, the volume of chemical injected into seawater is adjusted. In particular, the first chemical flowrate may be increased or decreased to a second chemical flowrate to achieve a desired flowrate ratio relative to seawater flowrate. In one or more embodiments, the volume of chemical injected into the seawater is adjusted to achieve an approximate predetermined set point. As noted above, chemical dosage rates may vary significantly depending on the operation and can be as low as 0.0004 litres/minute, chemical volumes which are very difficult to achieve consistently and accurately in proportion to the volume of seawater being pumped through chemical injection system 20, which may be approximately 0.01 litres/minute or more. In any event, chemical injected into the seawater may be adjusted by altering or moderating the speed of chemical injection process pump 38 or adjusting the open or closed position of a chemical control valve along a chemical injection flowline. Where the chemical injection process pump 38 is operated by an electric pump motor 42, the electrical input to the electric pump motor 42 can be adjusted to adjust or moderate the speed of the chemical injection process pump 38. In this regard, electric pump motor 42 may be a variable frequency drive motor and the electrical input can be adjusted by varying the frequency and voltage of the motor input.

In one or more embodiments, the predetermined set point is a desired ratio of measured chemical to measured seawater flowing to a subsea hydrocarbon production facility. The volume of chemical injected into seawater is automatically adjusted to substantially achieve the desired ratio of measured chemical to measured seawater flowing to a subsea hydrocarbon production facility.

Thus, a subsea chemical injection system has been described. In one embodiment, the subsea chemical injection system includes at least one seawater pump; at least one seawater volume flowmeter; at least one chemical injection flow control mechanism; and at least one chemical subsea mass flowmeter, wherein the chemical subsea mass flowmeter comprises a Coriolis tube housed in a pressure vessel. In other embodiments, the subsea chemical injection system includes a seawater flowline having a seawater inlet and a first seawater outlet; a chemical flowline in fluid communication with the seawater flowline between the seawater inlet and first sweater outlet; a high-pressure seawater pump disposed along the seawater flowline; a first seawater volume flowmeter disposed along the seawater flowline; at least one chemical injection flow control mechanism disposed along the chemical flowline; and at least one chemical subsea mass flowmeter disposed along the chemical flowline between the seawater flowline and the chemical injection flow control mechanism, wherein the chemical subsea mass flowmeter comprises a Coriolis tube housed in a pressure vessel; and wherein the chemical injection flow control mechanism is housed in the pressure vessel.

For any of the foregoing embodiments, the subsea chemical injection system may include any one of the following elements, alone or in combination with each other:

The pressure vessel has a nominal pressure rating of at least 100 bars.

The chemical injection flow control mechanism is a chemical injection process pump.

The chemical injection process pump is driven by a variable speed electric motor.

The chemical injection flow control mechanism is a controllable valve.

The controllable valve is actuated by an electric motor.

A pump skid.

A seawater flowline carried by the pump skid with the seawater pump disposed along the seawater flowline and the seawater volume flowmeter disposed along the seawater flowline.

A first chemical flowline in fluid communication with the seawater flowline with the chemical injection flow control mechanism disposed along the chemical flowline and the chemical subsea mass flowmeter disposed along the first chemical flowline downstream of the chemical injection flow control mechanism.

A pump skid; a seawater flowline carried by the pump skid with the seawater pump disposed along the seawater flowline and the seawater volume flowmeter disposed along the seawater flowline; a first chemical flowline in fluid communication with the seawater flowline with the chemical injection flow control mechanism disposed along the chemical flowline and the chemical subsea mass flowmeter disposed along the first chemical flowline downstream of the chemical injection flow control mechanism.

The chemical injection flow control mechanism is housed within the pressure vessel.

The chemical injection flow control mechanism is a chemical injection process pump housed within the pressure vessel, the chemical injection system further comprising an electric pump motor housed within the pressure vessel and disposed to operate the chemical injection process pump.

A mass flowmeter controller housed within the pressure vessel and electrically coupled to each of a Coriolis tube measurement mechanism housed within the pressure vessel and electric pump motor.

At least three Coriolis tubes housed in the pressure vessel and at least three chemical injection flow control mechanism housed within the pressure vessel, wherein the chemical injection flow control mechanisms are chemical injection process pumps.

Each chemical injection process pump is in fluid communication with a separate Coriolis tube.

At least two Coriolis tubes, each Coriolis tube in fluid communication with its own chemical injection flow control mechanism, wherein each chemical injection flow control mechanism is a chemical injection process pump, each Coriolis tube and its associated chemical injection process pump being housed within a pressure vessel at sea level ambient pressure and with a nominal pressure rating of at least 50 bars.

At least two chemical storage tanks, each chemical storage tank in fluid communication with one of the chemical injection process pumps.

At least two chemical storage tanks, each chemical storage tank in fluid communication with one of the chemical injection process pumps; at least two variable speed electric pump motors, each electric motor coupled to a chemical injection process pump to drive the chemical injection process pump, each variable speed electric pump motor disposed within the pressure vessel of the pump to which it is coupled; a Coriolis tube measurement mechanism disposed in a pressure housing with each Coriolis tube; a mass flowmeter controller disposed in a pressure housing with each Coriolis tube, each mass flowmeter controller electrically coupled to a Coriolis tube measurement mechanism and a variable speed electric pump motor; a chemical injection system controller in electrical communication with the seawater volume flowmeter and each mass flowmeter controller, the chemical injection system controller including a preselected setpoint and software program to automatically adjust operation of a pump motor based on a comparison of the seawater flow volume measured by seawater volume flowmeter, the chemical subsea mass flowmeter and the setpoint.

At least two variable speed electric pump motors, each electric motor coupled to a chemical injection process pump to drive the chemical injection process pump, each variable speed electric pump motor disposed within the pressure vessel of the pump to which it is coupled.

A Coriolis tube measurement mechanism disposed in a pressure housing with each Coriolis tube.

A mass flowmeter controller disposed in a pressure housing with each Coriolis tube, each mass flowmeter controller electrically coupled to a Coriolis tube measurement mechanism and a variable speed electric pump motor.

A chemical injection system controller in electrical communication with the seawater volume flowmeter and each mass flowmeter controller, the chemical injection system controller including a preselected setpoint and software program to automatically adjust operation of a pump motor based on a comparison of the seawater flow volume measured by seawater volume flowmeter, the chemical subsea mass flowmeter and the setpoint.

A second seawater outlet disposed along the seawater flowline.

A low-pressure seawater pump disposed along the seawater flowline.

A second seawater volume flowmeter disposed along the seawater flowline between the low-pressure seawater pump and the second seawater outlet.

Each seawater pump coupled to and driven by a separate hydraulic motor.

The chemical flowline is in fluid communication with the seawater flowline between the seawater inlet and both of the seawater pumps.

The first seawater volume flowmeter is disposed between the high-pressure seawater pump and the first seawater outlet.

The subsea chemical injection system further including a second seawater outlet disposed along the seawater flowline; a low-pressure seawater pump disposed along the seawater flowline; a second seawater volume flowmeter disposed along the seawater flowline between the low-pressure seawater pump and the second seawater outlet; each seawater pump coupled to and driven by a separate hydraulic motor; wherein the chemical flowline is in fluid communication with the seawater flowline between the seawater inlet and both of the seawater pumps.

Relatedly, a method for injecting chemicals into a subsea hydrocarbon production facility has been described. Embodiments of the subsea chemical injection method may include pumping seawater through a chemical injection system disposed adjacent a subsea hydrocarbon production facility; measuring the volume of seawater pumped through chemical injection system; injecting one or more chemicals into the seawater as the seawater passes through chemical injection system; and measuring the mass flow of the chemical injected into the into seawater passing through chemical injection system, wherein the mass flow of the chemical is measured at a pressure less than the seawater within the chemical injection system.

For the foregoing embodiments, the method may include any one of the following steps, alone or in combination with each other:

Comparing the measured volume of seawater to the measured mass flow of the chemical and a predetermined set point and adjusting the injection of the one or more chemicals based on the comparison.

The injection of the chemical is adjusted by modulating the speed of a chemical injection pump to alter the flowrate of the injected chemical from a first chemical flowrate to a second chemical flowrate.

The mass flow of the chemical is measured at an atmospheric pressure of approximately 1 bar and the pressure of the pumped seawater is greater than 100 bar.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A subsea chemical injection system comprising:

at least one seawater pump;

at least one seawater volume flowmeter;

at least one chemical injection flow control mechanism; and at least one chemical subsea mass flowmeter, wherein the chemical subsea mass flowmeter comprises a Coriolis tube housed in a pressure vessel.

2. The subsea chemical injection system of claim 1, wherein the pressure vessel has a nominal pressure rating of at least 100 bars.

3. The subsea chemical injection system of claim 1, wherein the chemical injection flow control mechanism is a chemical injection process pump.

4. The subsea chemical injection system of claim 3, wherein the chemical injection process pump is driven by a variable speed electric motor.

5. The subsea chemical injection system of claim 1, wherein the chemical injection flow control mechanism is a controllable valve.

6. The subsea chemical injection system of claim 5, wherein the controllable valve is actuated by an electric motor.

7. The subsea chemical injection system of claim 1, further comprising a pump skid;

a seawater flowline carried by the pump skid with the seawater pump disposed along the seawater flowline and the seawater volume flowmeter disposed along the seawater flowline;

a first chemical flowline in fluid communication with the seawater flowline with the chemical injection flow control mechanism disposed along the chemical flowline and the chemical subsea mass flowmeter disposed along the first chemical flowline downstream of the chemical injection flow control mechanism.

8. The subsea chemical injection system of claim 1, wherein the chemical injection flow control mechanism is housed within the pressure vessel.

9. The subsea chemical injection system of claim 8, wherein the chemical injection flow control mechanism is a chemical injection process pump housed within the pressure vessel, the chemical injection system further comprising an electric pump motor housed within the pressure vessel and disposed to operate the chemical injection process pump.

10. The subsea chemical injection system of claim 9, further comprising a mass flowmeter controller housed within the pressure vessel and electrically coupled to each of a Coriolis tube measurement mechanism housed within the pressure vessel and electric pump motor.

11. The subsea chemical injection system of claim 10, wherein each chemical injection process pump is in fluid communication with a separate Coriolis tube.

12. The subsea chemical injection system of claim 1, further comprising at least three Coriolis tubes housed in the pressure vessel and at least three chemical injection flow control mechanism housed within the pressure vessel, wherein the chemical injection flow control mechanisms are chemical injection process pumps.

13. A subsea chemical injection system comprising:

a seawater flowline having a seawater inlet and a first seawater outlet;

a chemical flowline in fluid communication with the seawater flowline between the seawater inlet and first sweater outlet;

a high-pressure seawater pump disposed along the seawater flowline;

a first seawater volume flowmeter disposed along the seawater flowline;

at least one chemical injection flow control mechanism disposed along the chemical flowline; and at leastonechemicalsubseamassflowmeterdisposedalongthechemicalflowlinebetween the seawater flowline and the chemical injection flow control mechanism, wherein the chemical subsea mass flowmeter comprises a Coriolis tube housed in a pressure vessel; and wherein the chemical injection flow control mechanism is housed in the pressure vessel.

14. The subsea chemical injection system of claim 13, further comprising at least two Coriolis tubes, each Coriolis tube in fluid communication with its own chemical injection flow control mechanism, wherein each chemical injection flow control mechanism is a chemical injection process pump, each Coriolis tube and its associated chemical injection process pump being housed within a pressure vessel at sea level ambient pressure and with a nominal pressure rating of at least 50 bars.

15. The subsea chemical injection system of claim 14, further comprising:

at least two chemical storage tanks, each chemical storage tank in fluid communication with one of the chemical injection process pumps;

at least two variable speed electric pump motors, each electric motor coupled to a chemical injection process pump to drive the chemical injection process pump, each variable speed electric pump motor disposed within the pressure vessel of the pump to which it is coupled; a Coriolis tube measurement mechanism disposed in a pressure housing with each Coriolis tube; a mass flowmeter controller disposed in a pressure housing with each Coriolis tube, each mass flowmeter controller electrically coupled to a Coriolis tube measurement mechanism and a variable speed electric pump motor; a chemical injection system controller in electrical communication with the seawater volume flowmeter and each mass flowmeter controller, the chemical injection system controller including a preselected setpoint and software program to automatically adjust operation of a pump motor based on a comparison of the seawater flow volume measured by seawater volume flowmeter, the chemical subsea mass flowmeter and the setpoint.

16. The subsea chemical injection system of claim 15, wherein the first seawater volume flowmeter is disposed between the high-pressure seawater pump and the first seawater outlet; the subsea chemical injection system further comprising:

a second seawater outlet disposed along the seawater flowline;

a low-pressure seawater pump disposed along the seawater flowline;

a second seawater volume flowmeter disposed along the seawater flowline between the low-pressure seawater pump and the second seawater outlet;

each seawater pump coupled to and driven by a separate hydraulic motor; wherein the chemical flowline is in fluid communication with the seawater flowline between the seawater inlet and both of the seawater pumps.

17. A method for injecting chemicals into a subsea hydrocarbon production facility, the method comprising:

pumping seawater through a chemical injection system disposed adjacent a subsea hydrocarbon production facility;

measuring the volume of seawater pumped through chemical injection system;

injecting one or more chemicals into the seawater as the seawater passes through chemical injection system;

measuring the mass flow of the chemical injected into the seawater passing through chemical injection system, wherein the mass flow of the chemical is measured at a pressure less than the seawater within the chemical injection system;

comparing the measured volume of seawater to the measured mass flow of the chemical and a predetermined set point; and adjusting the injection of the one or more chemicals based on the comparison.

18. The method of claim 17, wherein the injection of the chemical is adjusted by modulating the speed of a chemical injection pump to alter the flowrate of the injected chemical from a first chemical flowrate to a second chemical flowrate.

19. The method of claim 8, wherein the mass flow of the chemical is measured at an atmospheric pressure of approximately 1 bar and the pressure of the pumped seawater is greater than 100 bar.

20. The method of claim 17, wherein, wherein the injection of the chemical is adjusted by adjusting an open or closed position of a chemical control valve.

* * * * *